US007168367B2

(12) United States Patent
Levy et al.

(10) Patent No.: US 7,168,367 B2
(45) Date of Patent: Jan. 30, 2007

(54) SUBMUNITION FUZE

(75) Inventors: Amir Levy, Kiryat Ono (IL); Asaf Hargaash, PetachTikva (IL); Ran Yerushalmi, Herzlia (IL); Amnon Hay, Rehovot (IL)

(73) Assignee: Israel Military Industries Ltd., Ramat Hasharon (IL)

( * ) Notice: Subject to any disclaimer, the term of this patent is extended or adjusted under 35 U.S.C. 154(b) by 33 days.

(21) Appl. No.: 10/817,535

(22) Filed: Apr. 2, 2004

(65) Prior Publication Data

US 2005/0188884 A1 Sep. 1, 2005

(30) Foreign Application Priority Data

Apr. 3, 2003 (IL) ..... 155219

(51) Int. Cl.
*F42B 12/62* (2006.01)

(52) U.S. Cl. ..... 102/489; 102/222; 102/232; 102/237; 102/245

(58) Field of Classification Search ..... 102/489, 102/222, 231, 232, 233, 237, 238, 245
See application file for complete search history.

(56) References Cited

U.S. PATENT DOCUMENTS 4,811,664 A * 3/1989 Levy et al. ..... 102/226
4,848,235 A * 7/1989 Postler et al. ..... 102/393
4,986,184 A * 1/1991 Kude ..... 102/256
5,275,101 A * 1/1994 Chemiere et al. ..... 102/235

OTHER PUBLICATIONS

Israel Military Industries Ltd., Brochure for *CL 3677-SDN-Self Destruct Fuze for the M42/46 Grenade*, pp. 1-2 (Feb. 2003)—admitted prior art.

* cited by examiner

*Primary Examiner*—Michael J. Carone
*Assistant Examiner*—Stewart Knox
(74) *Attorney, Agent, or Firm*—Seyfarth Shaw LLP

(57) ABSTRACT

An improved fuze for a submunition grenade designed to be launched from a cargo projectile comprising a fuze, a charge and a casing;

the improved fuze comprising a fuze housing; a threaded firing pin having a pointed tip, oriented coaxially with the submunition grenade, and threadedly engageable to a threaded hole in a weighted insert that is able to reciprocate within the fuze housing;

a slider slidingly moveable in a substantially radial plane tangential to the axis of the firing pin, between a safe position and an armed position;

the firing pin being able to rotatably reciprocate forwards and backwards by rotation of the firing pin with respect to the weighted insert along the threadedly engaged screw threads; the fuze further comprising a fully mechanical inertial releasable safety apparatus for preventing swiveling of the swivel mounted striker, to prevention initiation of the time delay detonator ignition system.

12 Claims, 11 Drawing Sheets

SUBMUNITION FUZE

FIELD OF INVENTION

The present invention relates to military ordnance, particularly to safety devices for submunitions.

BACKGROUND OF THE INVENTION

Sometimes, on the battlefield, heavy cannon, such as artillery pieces, tanks and the like, are deployed against foot soldiers, particularly where the target is out of range of machine gun bullets, or where there is no line of sight with the target. It will be appreciated however, that very small changes in elevation of the cannon will have a major effect on where a shell will land, and this results in an inherent difficulty in using heavy artillery against soldiers. Furthermore, a company of foot soldiers may be spread out over an area of land, and the damage caused by a conventional shell is too localized to be of much use. One known approach for destroying foot soldiers under these conditions is to use a 'cargo projectile' loaded with submunition grenades. The cargo projectile is a shell that is designed to be fired from a large caliber cannon such as a tank or artillery piece over the position of enemy foot soldiers. A plurality of submunition grenades are released and dispersed from the cargo projectile over a large area of ground. Some such submunition grenades are designed to self destruct in the air. Others are designed to explode on impact.

The basic requirements for submunition grenades are (i) a high degree of safety during storage and handling, both prior, during and subsequent to their being packed into cargo projectiles, (ii) reliability during deployment, i.e. that they should explode appropriately after release from the cargo projectile, and not prematurely, prior to their dispersal, and (iii) the number of dangerous dud grenades that do not explode on impact should be minimized. This is most important, as their being scattered over the battlefield poses a hazard to friendly troops and even to civilians or wildlife long after the battle. It will be appreciated that these requirements are to some extent contradictory, and the development of safe but highly explosive ordnance is not trivial.

Each submunition grenade includes a casing that disintegrates into lethal shrapnel when the submunition grenade explodes, a warhead for exploding the casing, and a fuze for detonating the warhead. To achieve the required safety levels in handling and storage, but reliability of the submunition grenade after releasing, the fuzes thereof are sophisticated devices that generally include chemical, mechanical and occasionally electrical subcomponents.

Typically the fuze of an impact type of submunition grenade includes a chemical detonator and a firing pin that triggers the detonator on impact. To allow the grenades and the cargo projectiles that contain such grenades to be handled safely, various safety mechanisms have been devised. Typically, in addition to the armed position in which is the grenade's fuze aligned to trigger the detonator, the firing pin of the submunition grenade also has a safe position, and when the firing pin is in this safe position, the submunition grenade can be handled and even dropped without fear of it detonating. Once the firing pin is moved to the armed position however, an impact or similar jolt will cause the pin to detonate the detonator, igniting the warhead thereby and causing the submunition grenade to explode.

Submunition grenades have been developed that not only are stored with their firing pins in the unarmed position, but their firing pins are only moved to the armed position after launching. In one such mechanism, only after the submunition grenade falls clear of the cargo projectile, the firing pin is brought into the activated position, where, on impact, the pin can detonate the detonator and thereby ignite the lead warhead.

Submunition grenade fuzes are known that have a locked safe position for the firing pin that is designed to prevent the firing pin from being moved to the armed position inadvertently. When the grenades are packed into a cargo projectile carrier, the firing pin of each grenade fuze is unlocked, but it remains in its safe position until the fuze is armed. This only happens after the submunition grenade is ejected from the cargo projectile. In a submunition grenade of this type, one end of the shaft of the firing pin protrudes outside the fuze housing, and to the protruding end a drag producing means is fitted. The cargo projectile warhead spins in flight due to rifling of the barrel of the gun from which it is launched. When the grenades are ejected from the cargo projectile, the drag producing means, typically a nylon ribbon is activated. This drag producing means acts in an inertial manner, countering the spin of the submunition grenade around its longitudinal axis, and displaces the firing pin assembly, causing it to assume a striking position. In his manner, the fuze is armed automatically, but only after ejection. On impact, the firing pin assembly is driven into the grenade with a force that causes the detonation of the fuze detonator and explosion of the warhead thereby.

A known safety mechanism for submunition grenades is a slider assembly that keeps the detonator in a safe position away from the firing pin, preventing inadvertent detonation. After being detached from the cargo projectile, the centrifugal forces on the submunition grenade cause the slider assembly to slide into the armed position, aligning the detonator with the firing pin. Once aligned, a catch locks the slider in place such that upon appropriate impact, such as an impact with a hard surface, the firing pin is driven forward to strike the appropriately aligned detonator, detonating it, thereby igniting the warhead of the submunition grenade.

Like all mechanical systems, such slider assemblies are not fail-safe. Occasionally, they do not retract, or do not retract fully. This can happen, for example, when the striker assembly is locked for some reason.

One disadvantage of the prior art submunition fuzes described hereinabove, is that where the submunition grenade impacts with an inappropriate surface, such as a soft surface, or where the angle of impact is wrong, such that the firing pin is not induced to strike the detonator, the grenade is not detonated.

Consequently, there is a risk of armed submunition grenades launched at the enemy but not detonated on impact being left scattered over the battlefield. Wherever a submunition grenade does not detonate it is considered as being a "dud". Armed dud submunition grenades remain dangerous, and pose a risk to friendly troops and even to civilians long after the battle.

Thus, despite the many safety features included in submunition grenades, there is still a risk of armed submunition grenades being dispersed but not detonated, and the present invention addresses this risk.

SUMMARY OF THE INVENTION

It is an object of the present invention to provide an improved fuze for submunition grenades.

It is a further object that embodiments of the present invention include safety mechanisms for neutralizing 'dud' submunition grenades, thereby preventing dangerous dads being left on the battlefield.

It is yet a further object of the invention to provide a fuze for submunition grenades having increased reliability, so that number of successfully detonated grenades is maximized, minimizing the occurrence of duds.

In a first aspect, the present invention is directed to the provision of an improved fuze for a submunition grenade designed to be launched from a cargo projectile; said cargo projectile comprising a fuze, a warhead and a casing; the improved fuze comprising a fuze housing; a threaded firing pin oriented coaxially with the submunition grenade, and threadedly engageable to a threaded hole in a weighted insert that is able to reciprocate within the fuze housing;

said firing pin having a pointed tip;

said firing pin being able to rotatably reciprocate between a forward position and a retracted position by rotation of said firing pin with respect to said weighted insert along said threadedly engaged screw threads;

a slider slidingly moveable in a substantially radial plane tangential to the axis of the firing pin, between a safe position and an armed position;

said slider having a cavity therein for engaging the pointed tip of the firing pin when said slider is in said safe position and said firing pin is in said forward position; said slider having a stab detonator attached to an inner end of said slider, such then when said slider is in said safe position and said pointed tip engages said cavity, said stab detonator is securely held with said housing, and when said firing pin is in said retracted position and said slider is slid into said armed position, the stab detonator is brought into alignment with said firing pin, for detonation thereby after an impact or jolt;

said slider further comprising a time delay detonator ignition system for delayed ignition of the stab detonator and a spin activated swivel mounted striker for activating the time delay detonator ignition mechanism, such that spin of the submunition grenade applies a centrifugal force on the firing pin and causes retraction of the firing pin along threadedly engaged screw threads into said weighted insert, retracting said tip out of said cavity, cocking the firing pin; such that spin of the submunition grenade further applies a centrifugal force on said slider urging it from said safe position into said armed position, bringing said stab detonator into alignment with said firing pin;

said fuze further comprising a fully mechanical inertial releasable safety apparatus for preventing swiveling of said swivel mounted striker, to prevention initiation of said time delay detonator ignition system.

Preferably, the time delay detonator ignition system comprises a pyrotechnic combustion charge and a percussion cap, such that said percussion cap is triggerable by an impact resulting from swiveling of said swivel mounted striker, and said percussion cap actuates said pyrotechnic combustion charge for ignition of said stab detonator.

Preferably:

(a) release of said Swivel mounted striker whilst said slider is in said safe position triggers said time delay detonator ignition system, resulting in ignition of said stab detonator after said time delay whilst said stab detonator is held securely in said housing, disarming said submunition grenade thereby, rendering it relatively harmless;

(b) when said ring pin retracts and the slider is moved into the armed position bringing the stab detonator into alignment with the firing pin and arming the submunition grenade thereby, in absence of the firing pin initiating the stab detonator, the time delay detonator ignition system initiates the stab detonator after elapsing of the time delay;

(c) wherein spin of the submunition grenade causes an inertial force to be applied to the firing pin, resulting in retraction of the firing pin out of the cavity, cocking the firing pin; the spin of the submunition grenade further applies an inertial force onto the slider urging it from safe position into said armed position, bringing said stab detonator into alignment with said firing pin.

Generally, the inertial force includes a centrifugal force.

Optionally in addition or as an alternative, the inertial force may include a sudden jolt resulting from launching of said cargo projectile, or a sudden jolt resulting from said submunition grenade being expelled from said cargo projectile.

In a first embodiment, the fully mechanical inertially releasable safety apparatus comprises a small block tat is wedgeable into the fuze housing and, when wedged therein, the small block prevents the swiveling of the swivel mounted striker, such that upon the submunition grenade being ejected from the cargo projectile, spin of the submunition grenade results in a centrifugal force that causes detachment of said block from the fuze housing; said detachment of the block allows the swivel mounted striker to swivel into a position such that it strikes said percussion cap and activates the time delay detonator ignition system.

In a second embodiment, wherein the fully mechanical inertially releasable safety apparatus comprises a flat pin and a resilient retain means; said flat pin being able to reciprocate between an inner position and an outer position, said resilient retaining means for urging said flat pin towards said inner position, such that upon expulsion of said submunition grenade from said cargo projectile, inertial forces causes the flat pin to slide out of the fuze housing, allowing the slider assembly to slide out of the fine housing assuming said outer position and releasing said swivel mounted striker.

Typically the inertial forces include centrifugal forces resulting from spinning of the submunition grenade.

Alternatively or in addition, the inertial forces may include a sudden jolt resulting from an unraveling of a drag means attached to said flat pin on expulsion of the submunition grenade from the cargo projectile.

In a third embodiment, the fully mechanical inertially releasable safety apparatus comprises a spring-pin resiliently mounted within a cylinder and retractable there into, said spring pin and said cylinder being aligned with longitudinal axis of said submunition grenade.

It a second aspect, the present invention is directed to a submunition grenade including an improved fuze as described hereinabove.

In the present specification and claims, the following terms, where used, have the following meanings:

"Cargo Projectile" refers to the carrier, shell or warhead casing, which is designed to be launched by a large caliber gun, such as an artillery piece, tank, cannon or the like, and is designed to carry a plurality of submunition grenades into the air, for expulsion therefrom.

"Submunition Grenade" refers to an individual submunition, generally distributed by a cargo projectile.

The term "axis" of the fuze is the longitudinal axis; "radial" refers to the plane perpendicular to the axis.

BRIEF DESCRIPTION OF THE DRAWINGS

The present invention will be more fully understood and appreciated from the following detailed description, taken in conjunction with the drawings, in which the same number identifies identical components, and the same superscript identifies the same specific embodiment. Lack of a superscript implies that the component is identical in all embodiments in which it appears. The same number having different superscripts implies essentially the same component, with minor structural variations applicable to the embodiment implied by the superscript.

DETAILED DESCRIPTION THE INVENTION

Figure 1:
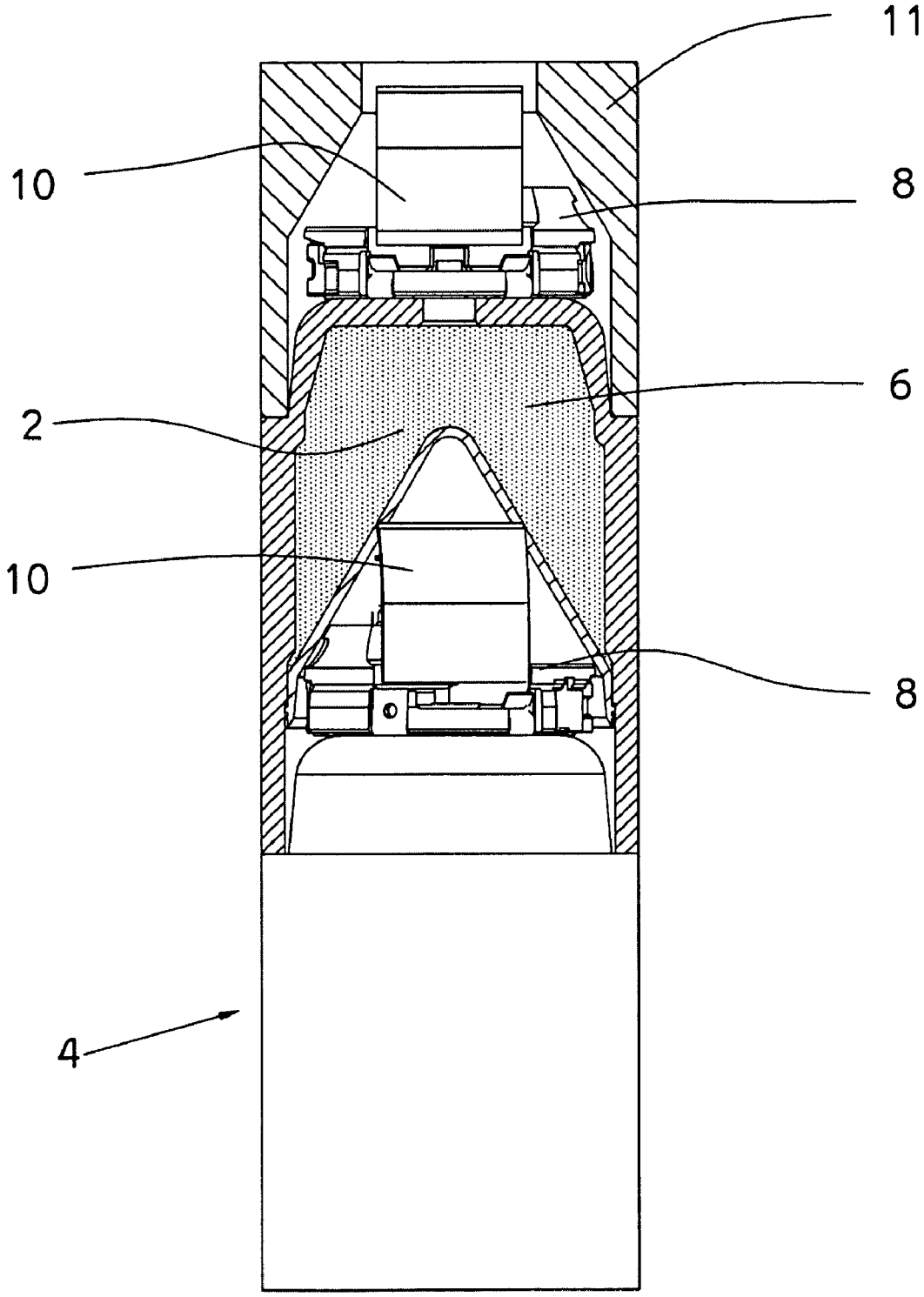
FIG. 1 is a schematic, partly cut-away view of a stack of grenades as arranged inside a carrier, the tail end of the carrier being shown at the top of the figure.

With reference now to FIG. 1, there is shown, in schematic, partly cut-away view, a stack of submunition grenades 2, arranged inside a cargo projectile 4. Each submunition grenade 2 includes a warhead 6 in which is mounted a fuze 8, constructed and operative in accordance with the present invention. Attached to the submunition grenade 2 there is a stabilizer 10 that typically a folded length of nylon ribbon 87 (FIG. 2A) that unfurls when the submunition grenade 2 is discharged from the cargo projectile 4, and acts as a drag thereon. Typically such a stabilizer 10 is attached to the fuze, and is used to arm the cargo projectile 4 after launch. Over the bottom submunition grenade in the stack, at the base end of the cargo projectile 4, there is typically a base adapter 11. Cargo projectiles 4 containing submunition grenades 2 are known ordnance used by the military against targets such as infantry, and the present invention relates to improved fuzes 8 thereof.

Figure 2A:
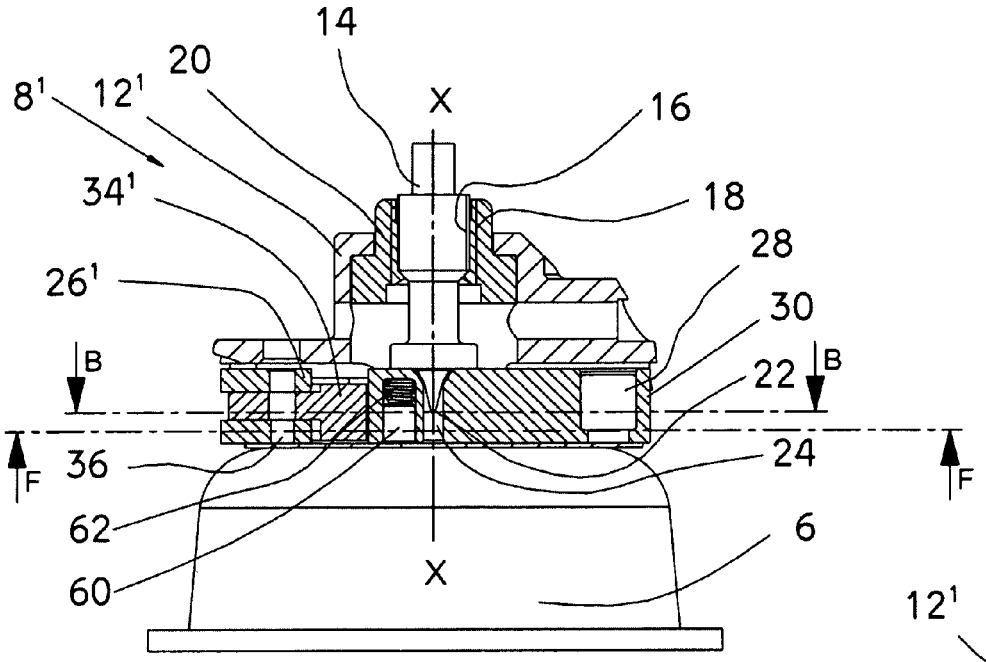
FIG. 2A is a side-sectional view of the fuze constructed and operative in accordance with the present invention, in an unarmed position.
Figure 2C:
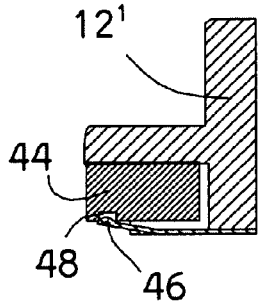
FIG. 2C is a sectional view of the section line C—C as in FIG. 2B.
Figure 2B:
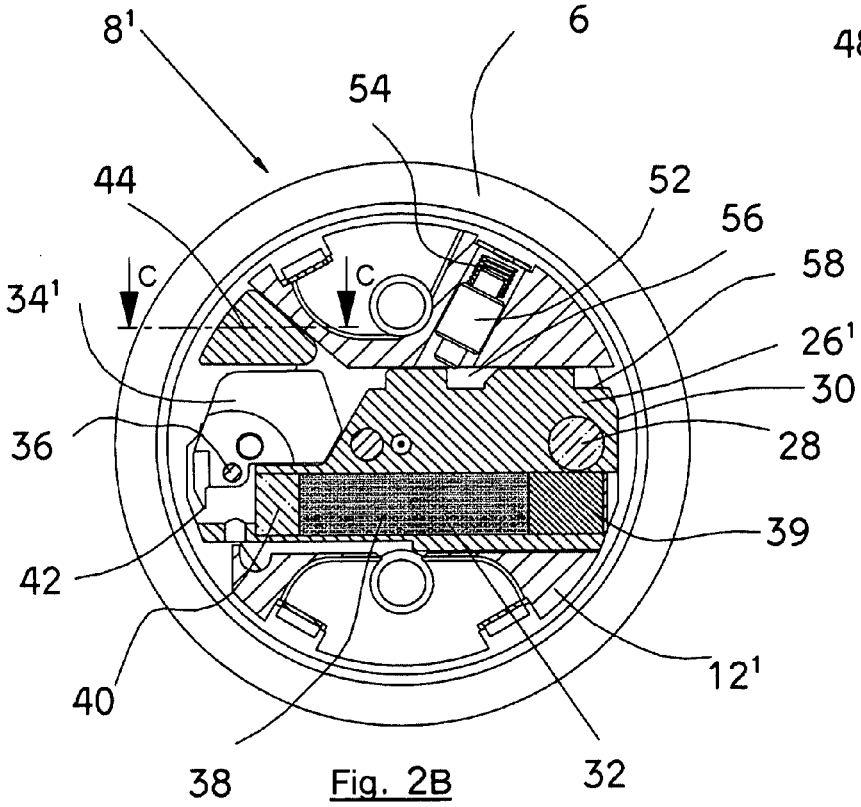
FIG. 2B is a sectional view of the fuze of FIG. 2A taken along line B—B therein.

Reference is now made to FIGS. 2A, 2B and 2C, which show a first embodiment of an improved fuze $\mathbf{8}^1$ constructed and operative in accordance with the present invention, in an unarmed position. FIG. 2A is a side-sectional view of the fuze, FIG. 2B is a sectional view of an improved fuze $\mathbf{8}^1$ taken along line B—B of FIG. 2A, and FIG. 2C is a sectional view of the improved fuze $\mathbf{8}^1$ taken along section line C—C of FIG. 2B.

The improved fuze $\mathbf{8}^1$ is part of a submunition grenade 2 comprising the improved fuze and the warhead 6, both enclosed within a casing. When initiated, the fuze $\mathbf{8}^1$ ignites the warhead and this explodes, causing the casing to disintegrate into lethal shrapnel. The improved fuze $\mathbf{8}^1$ is directed at providing a reliable means of igniting the warhead 6 subsequent to the submunition grenade 2 separating from the cargo projectile 4 after launching, such that the improved fuze, the submunition grenade including the fuze, and the cargo projectile containing such submunition grenades are all relatively safe to handle, since the improved fuze includes a number of safety features designed to achieve the aims: (i) to prevent accidental initiation of the submunition grenade prior to the cargo projectile being launched correctly, (ii) to ensure that once the cargo projectile is launched, the warhead of the submunition grenade is most unlikely not to be detonated, such that the number of properly launched submunition grenades that explode is maximized, and (iii) to ensure that any properly launched submunition grenades that do not explode, due to their warheads not being ignited properly (that is, duds), will be rendered harmless by their fuzes being disabled such that the likelihood of inadvertent subsequent explosions thereof, be minimized.

The improved fuze $\mathbf{8}^1$ comprises a fuze housing $\mathbf{12}^1$, a primary firing pin 14 oriented coaxially with the long axis X—X of the submunition grenade 2, the firing pin 14 having a thread 16 tapped therearound, that is threadedly engagable to a threaded hole 18 in a weighted insert 20 of the fine $\mathbf{8}^1$, that fits into the fine housing $\mathbf{12}^1$, such that the firing pin 14 is able to reciprocate within the weighted insert 20 of the fuze housing $\mathbf{12}^1$ between a forward position and a retracted position, by the firing pin 14 rotating with respect to the weighted insert 20 along mating screw threads 16, 18. The firing pin 14 has a pointed tip 22 thereon, disposed such that the pointed tip 22 of the firing pin 14 engages a cavity 24 within a slider 26 that is slidingly moveable, i.e. able to slide in a substantially radial plane, between a safe position as shown in FIGS. 2A and 2B, and an armed position illustrated in FIGS. 3A, 3B and 5A, 5B, 6A, 6B described hereinbelow. In addition to having a cavity 24 therein for engaging the pointed tip 22 of the firing pin 14, when the slider 26 is in the safe position and the firing pin 14 is in its forward position, the slider 26 also includes a stab detonator 28 attached near one end 30 of the slider 26, such then when the slider 26 is in the safe position (FIGS. 2A, 2B), the pointed tip 22 engages the cavity 24 and the stab detonator 28 is securely held within the housing 12[1]. However, when the firing pin 14 is in the retracted position and the slider 26 is slid into its armed position (see FIGS. 3A, 3B hereinbelow), the stab detonator 28 is brought into alignment with the firing pin 14, such that it may be detonated thereby due to an impact or jolt causing the firing pin 14 and weighted insert 20 to be rammed thereinto. The slider 26 also comprises a time delay detonator ignition system 32 for delayed ignition of the stab detonator 28 and a spin activated swivel mounted striker 34 attached thereto via a pivot 36 for activating the time delay detonator ignition system 32.

The spinning of the submunition grenade 2 around its axis X—X imparted thereto in consequence of the spinning of the cargo projectile 4 due to the rifling of the cannon from which it is fired, applies a centrifugal force on the firing pin 14 and causes the tip 22 of the firing pin 14 to retract out of the cavity 24, cocking the firing pin 14. This retracting of the firing pin 14 is typically and preferably a result of the stabilizer 10 unfurling causing a drag that opposes the spin of the submunition grenade and causes the firing pin 14 to screw backwards along the mated screw threads. Spin of the submunition grenade 2 also applies a centrifugal force on the slider 26 urging it from the safe position shown in FIGS. 2A, 2B into the armed position (see FIGS. 3A, 3B hereinbelow), such that once the tip 22 of the firing pin 14 is retracted out of the cavity 24, the slider 26[1] moves into the armed position bringing the stab detonator 28 into alignment with the tip 22 of the firing pin 14.

As mentioned hereinabove, the slider 26 includes a time delay detonator ignition system 32. This system comprises a pyrotechnic combustion charge 38 and a percussion cap 40. Typically, the time delay detonator ignition system 32 further comprises a booster charge 39. The swivel mounted striker 34 has a striker tooth 42 thereon, such that if the striker 34 swivels around its pivot 36, tho striker tooth 42 impacts the percussion cap 40, igniting it. Subsequently, a combustion front is generated that progresses gradually along the pyrotechnic combustion charge 38, which acts as a "time fuze", towards the booster charge 39. The speed of combustion of the delay detonator ignition system 32 is such that under normal operating conditions, the submunition grenade 8 impacts before the combustion front reaches the booster charge 39, and the stab detonator 28 is detonated by the firing pin 14.

A distinctive feature of the improved fuze 8 of the present invention is the addition of a fully mechanical inertial safety apparatus for preventing the swiveling of the swivel mounted striker 34, to prevention initiation of the time delay detonator ignition system 32.

In the first embodiment, as illustrated in FIGS. 2A and 2B, the fully mechanical inertially releasable safety apparatus comprises a small block 44 that may be wedged into the fuze housing 12[1], and, when wedged therein, prevents the swiveling of the swivel mounted striker 34[1].

With particular reference to FIG. 2C, the small block 44 may be held in place by a resilient retaining element, such as a leaf spring 46, which engages a notch 48 in the block 44, holding it in position.

Figure 3A:
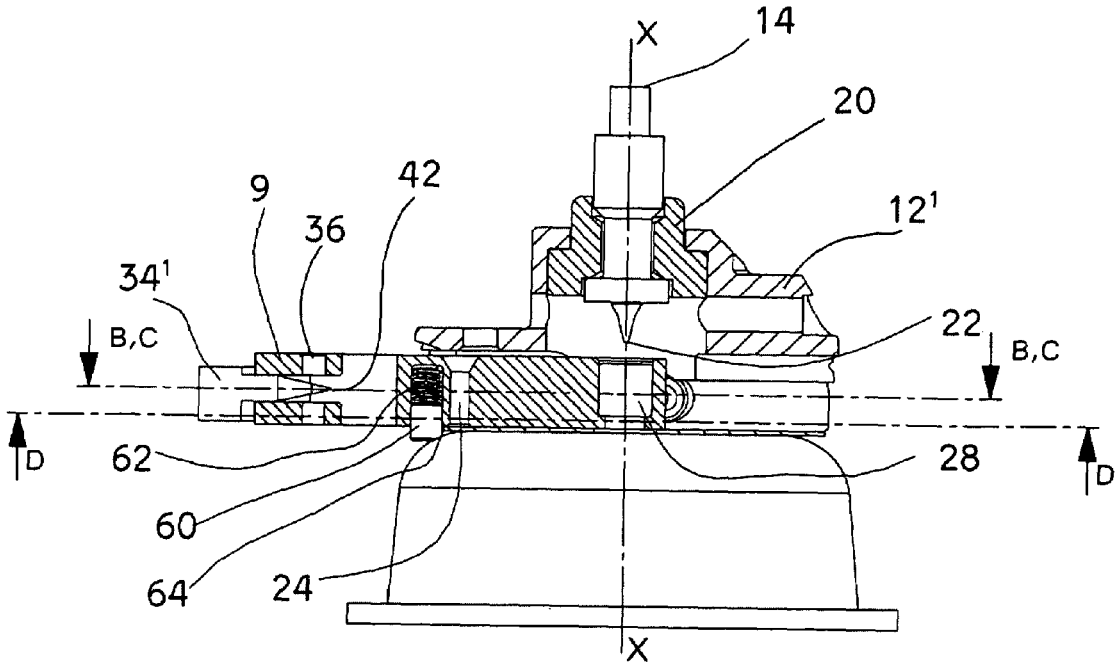
FIG. 3A is a side sectional view of the fuze of the invention, in an armed position.
Figure 3B:
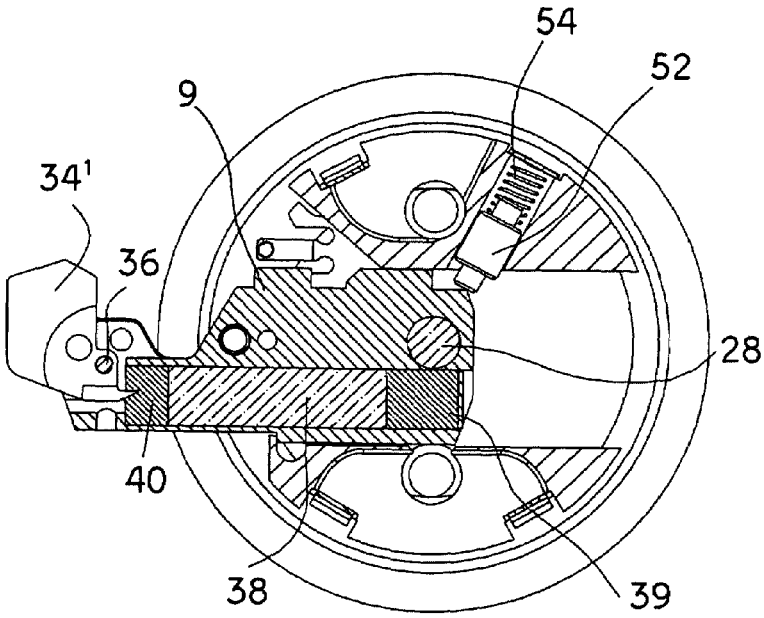
FIG. 3B is a sectional view of the fuze of FIG. 3A taken along line B—B therein.

However, with reference now to FIGS. 3A and 3B, subsequent to the submunition grenade 2 being ejected from the cargo projectile, spin of the submunition grenade 2 results in a centrifugal force that causes the retraction of the firing pin 14 along the mating screw threads 16, 18 causing the tip 22 thereof to be retracted out of the cavity 24[1], cocking the firing pin 14. Additionally, the same spinning of the submunition grenade 2 further applies a centrifugal fore on the slider 26[1] urging it from its safe position, shown in FIGS. 2A and 2B, into its armed position shown in FIGS. 4A and 4B), bringing the stab detonator 28 into alignment with the firing pin 14.

Figure 4A:
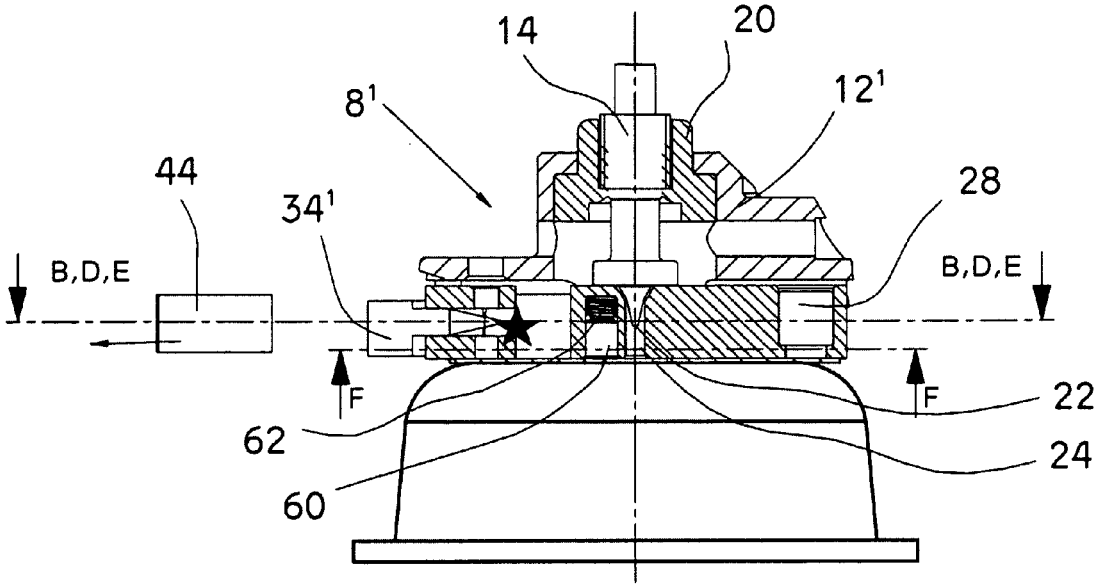
FIG. 4A is a side sectional view of the fuze of the invention, after ejection from the carrier.
Figure 4B:
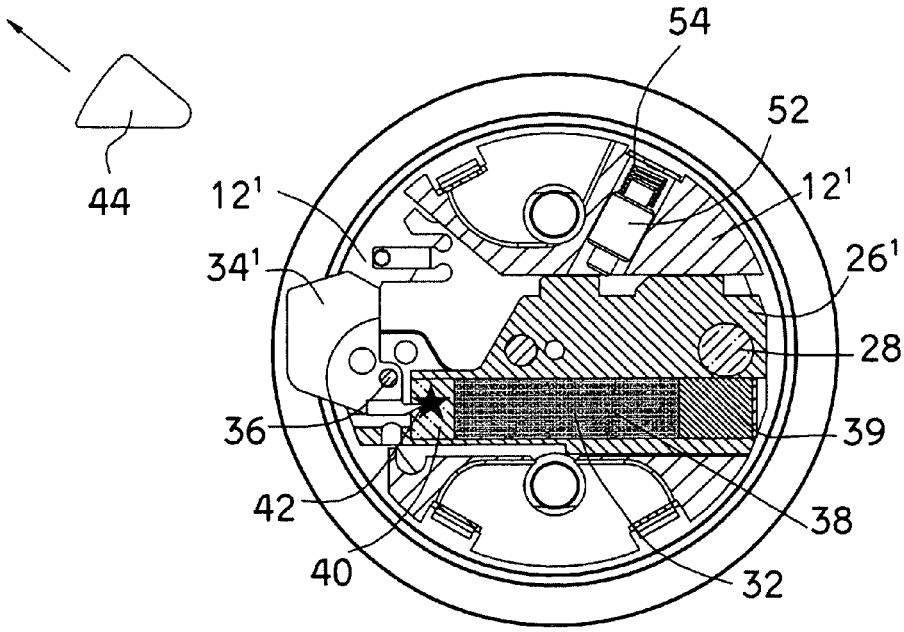
FIG. 4B is a sectional view of the fuze of FIG. 4A taken along line B—B therein.

Referring now to FIGS. 4A and 4B which show, in side sectional view and planar sectional view respectively, the improved fuze 8[1] of the first embodiment, after ejection of the submunition grenades 2 from the cargo projectile 2 and prior to the firing pin 14 being allowed to unscrew; the spin of the submunition grenade also causes detachment of the block 44 from the fuze housing 12[1], throwing it outwards. This allows the swivel mounted striker 34[1] to swivel around its pivot 36, into a position such that it strikes the percussion cap 40 and activates the time delay detonator ignition system 32. This inertial triggering of the time delay detonator ignition system 32 that is prevented from occurring by a fully mechanical inertially releasable safety apparatus, in this embodiment being a block 44, is an improvement to submunition grenade fines, and is a central feature of the present invention.

Figure 5A:
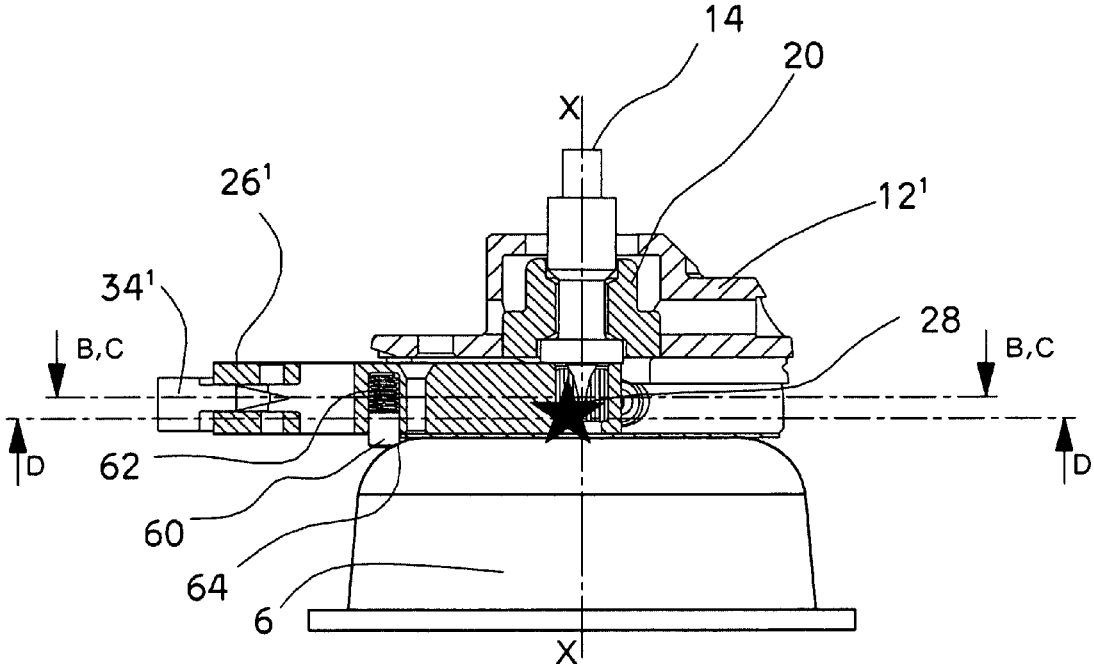
FIG. 5A is a side sectional view of the fuze of the invention, illustrating normal detonation thereof (impact mode).
Figure 5B:
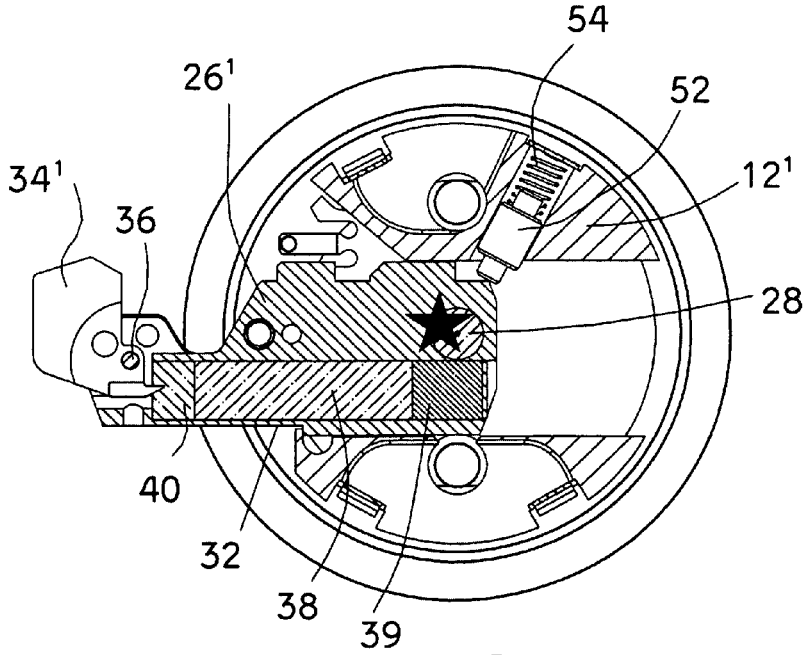
FIG. 5B is a sectional view of the fuze of FIG. 5A taken along line B—B therein.

Referring now to FIGS. 5A and 5B, where the firing pin 14 retracts normally, and the slider 26[1] slides outwards, bringing the stab detonator 28 into alignment with the tip 28 of the firing pin 14; a jolt resulting from the correct impacting of the submunition grenade 2 with the ground will cause the normal detonation of the submunition grenade by driving the firing pin 14 and weighted insert 20 forwards, so that the tip 28 of the firing pin 14 impacts the stab detonator 28 in the normal detonation manner, or "impact mode". Here, the time delay detonator ignition system 32 does not have any effect on the main impact detonation mechanism of the firing pin 14 and stab detonator 28 causes the warhead 6 to explode prior to the elapsing of the delay due to the pyrotechnic combustion charge 38.

Figure 6A:
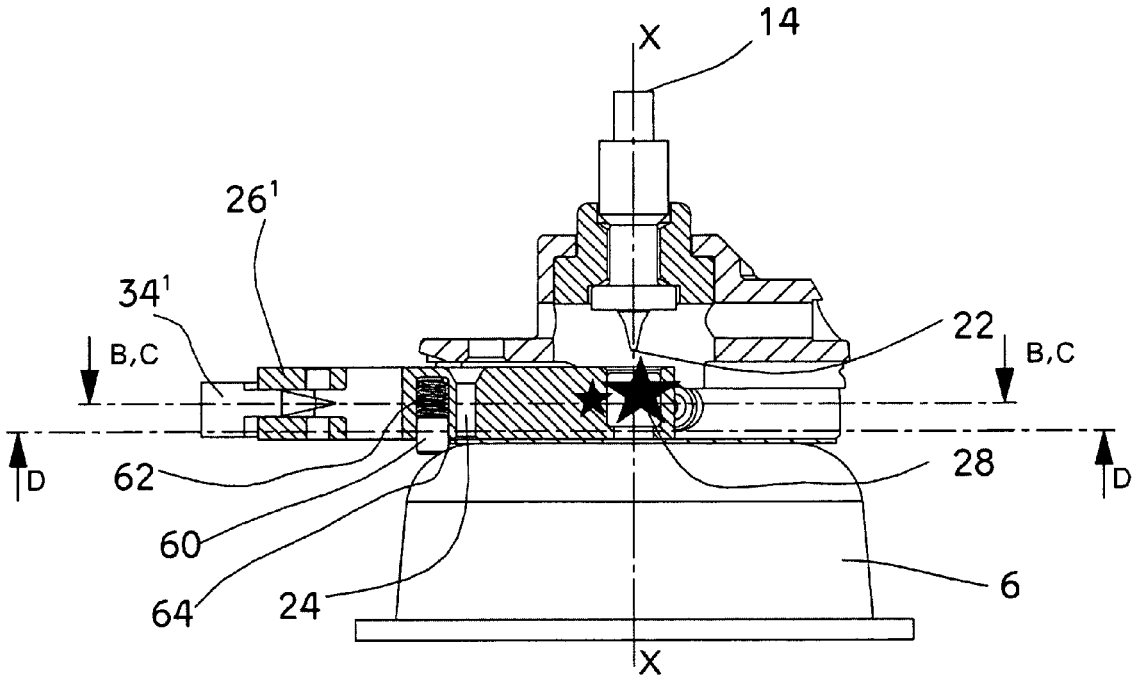
FIG. 6A is a side sectional view of the fuze of the invention, illustrating self-destruct mode action.
Figure 6B:
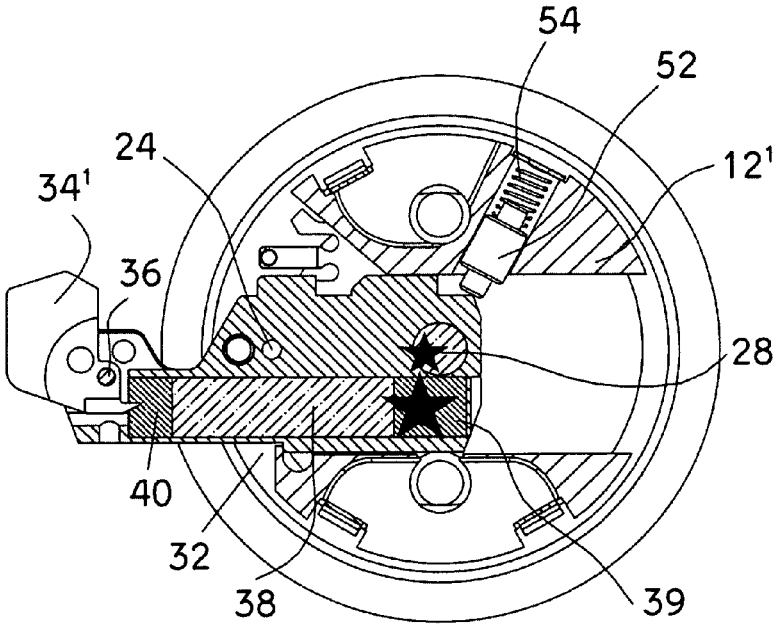
FIG. 6B is a sectional view of the fuze of FIG. 6A taken along line B—B therein.

Referring now to FIGS. 6A and 6B, where the firing pin 14 retracts normally and the slider 26[1] slides outwards, bringing the stab detonator 28 into line with the tip 22 of the firing pin 14, but the jolt resulting from an incorrect impacting of the submunition grenade 2 with the ground does not cause the normal detonation thereof, the tip 22 of the firing pin 14 being driven into the stab detonator 28 at all, or not with sufficient energy to ignite the stab detonator 28, i.e. in cases of failure of the primary impact detonation mechanism, the delay detonator ignition system 32 ignites the stab detonator 28 after the pyrotechnic combustion charge 38 burns through and the combustion front reaches and ignites the booster charge 39. Thus, should the tip 22 of the firing pin 14 fail to detonate the stab detonator 28 on impact, the time delay detonator ignition system 32 will ignite the stab detonator 28 after a time delay determined by the time delay inherent to the pyrotechnic combustion charge 38, as determined by the chemistry and dimensions thereof. Once ignited, the stab detonator 28 detonates the warhead 6. This safety device feature, henceforth "self-destruct mode action" is a back up reliability feature that ensures that very few dud submunition grenades fail to explode soon after impact, increasing the efficiency of the weapon.

Figure 7A:
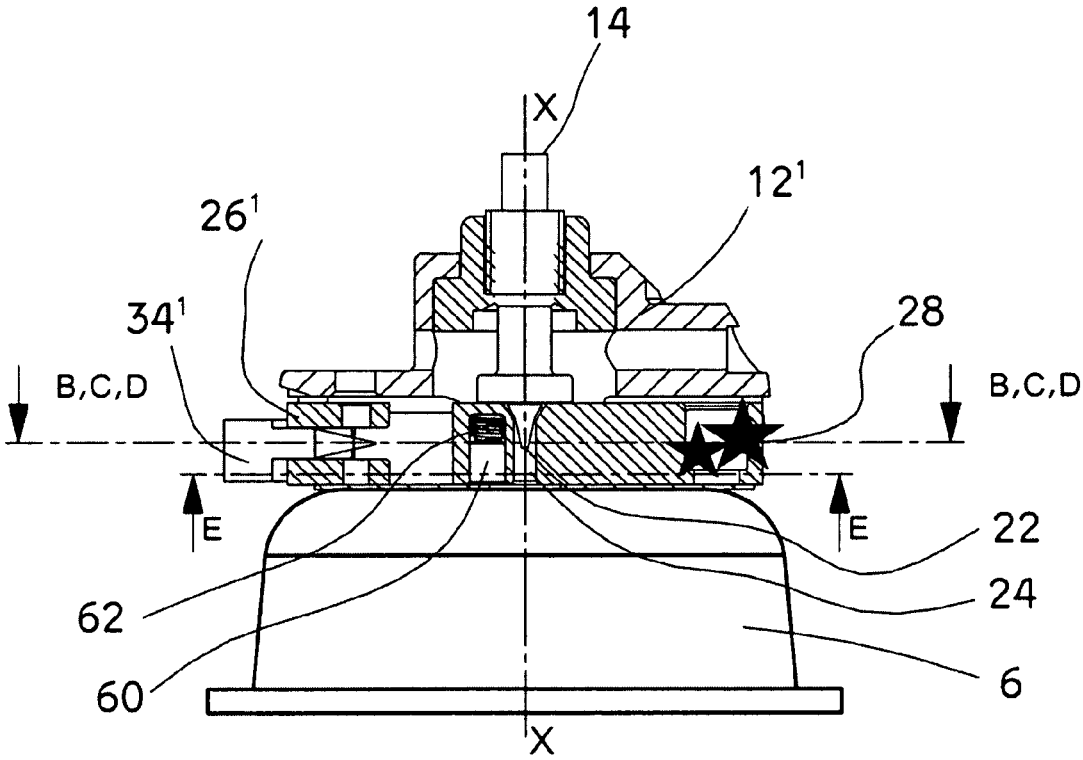
FIG. 7A is a side sectional view of the fuze of the invention, illustrating self neutralizing mode of an unarmed dud.
Figure 7B:
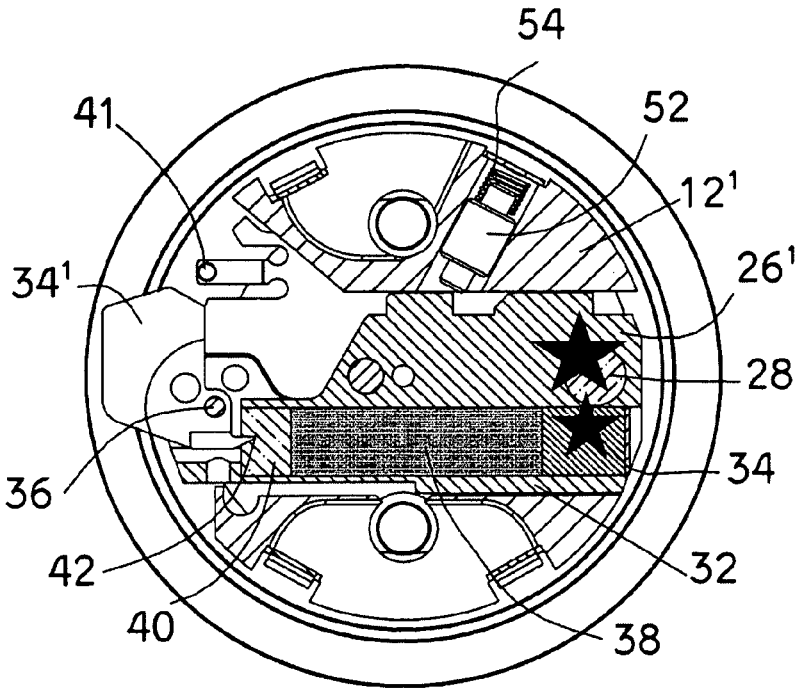
FIG. 7B is a sectional view of the fuze of FIG. 7A taken along line B—B therein.

Referring now to FIGS. 7A and 7B, it can occur that the submunition grenade 2 never becomes armed, due to the firing pin 14 not retracting and/or the slider 26 not sliding, should the spin of the submunition grenade release the block 44 from the fuze housing 12, throwing it outwards, the swivel mounted striker 34 will still swivel around its pivot 36, into a position such that it strikes the percussion cap 40 and activates the time delay detonator ignition system 32, by igniting the pyrotechnic combustion charge 38. This will cause the stab detonator 28 to be ignited after the pyrotechnic combustion charge 32 burns through, and the stab detonator 28 will be destroyed in the safe position, without detonating the warhead 6, and in this manner, unarmed duds get neutralized. This mode of operation is known henceforth hereinbelow as the "self neutralizing mode" of unarmed duds. By virtue of the "self neutralizing mode", the problem of unexploded submunition grenades 2 being left on the battlefield is virtually eliminated, since the grenade is now fuzeless and thus rendered harmless, and in this manner a dangerous hazard to friendly troops or to civilians is removed.

Thus it will be appreciated that in this first embodiment of the improved fuze of the present invention, there is total independence between the normal detonation mode and the self destructing and self neutralizing modes. Furthermore, the features described hereinabove are particularly safe and reliable since they do not rely on stored energy components, such as capacitors and batteries, or even on spring mechanisms and similar mechanical types of stored energy. Rather, the moving parts are mechanical, and the detachment of the block 44 and the movement of the swivel mounted striker 34$^1$ are accomplished by inertial energy resulting from the spin of the submunition grenade 2, initiated automatically as soon as the submunition grenade separates from the cargo projectile 4 (FIG. 1). Whilst within the cargo projectile 4 however, the block 44 is prevented from separating from the fuze 8 of each submunition grenade 2; either by the adjacent submunition grenade in the stack, or by the adapter 11 (FIG. 1).

Furthermore the structural demands of the block 44 are fairly minimal, and it may be made of any of a wide variety of materials, including biodegradable materials, recycled materials etc.

Having described this first embodiment of a fully mechanical inertial releasable safety apparatus for preventing swiveling of the swivel mounted striker 34, and thus preventing initiation of the time delay detonator ignition system 32 of the improved fuze 8 that is a subject of the present invention, additional components of the fuze that provide improved performance will be briefly described, to better enable the man of the art to construct an improved fuze in the best mode known to the applicants at this time.

Thus, referring again to FIGS. 2B, 4B, 5B and 6B there is shown a stop catch 52 that, prior to movement of the slider 26 into the armed position, compresses a resilient element 54, typically a helical spring. There are corresponding notches 56, 58 in the slider 26, that engage the spring loaded catch 52. Where no centrifugal force is applied onto the catch 52 and slider 26 by spin of the submunition grenade 2, the catch 52 engages the first notch 56 and prevents movement of the slider into the armed position. As shown in FIG. 3B however, when the slider 26 is first driven into the armed position, the catch 52 engages the notch 58. In this manner the stab detonator 28 is maintained in correct alignment with the tip 22 of the firing pin 14.

As shown in FIGS. 2A, 4A, 7A the slider 26$^1$ preferably includes a spring loaded locking plunger 60 that, when the slider 26$^1$ is in the unarmed position, compresses a resilient member 62 such as a helical spring. In the unarmed position, the long plunger 60 does not substantially retard movement of the slider 26$^1$. However, as shown in FIGS. 3A, 5A, and 6A, when the slider 26$^1$ is brought into the armed position, bringing the stab detonator 28 into alignment with the firing pin 14, the locking plunger 60 in released, and the resilient member 62 expands to release potential energy stored therein, driving the locking plunger 60 forwards. Once released, the locking plunger 60 engages the shoulder 64 of the warhead 6, and prevents the slider 26$^1$ from sliding back into the housing 12$^1$, and, in this manner, the stab detonator 28 is kept aligned with the firing pin 14, for impact detonation.

It will be appreciated that the detachable block 44 of the first embodiment is merely one type of fully mechanical inertial releasable safety apparatus. Other types of fully mechanical inertial releasable safety apparatus am conceivable that, in terms of their functionality, are very similar, although geometrically their appearance may be somewhat different.

Figure 8:
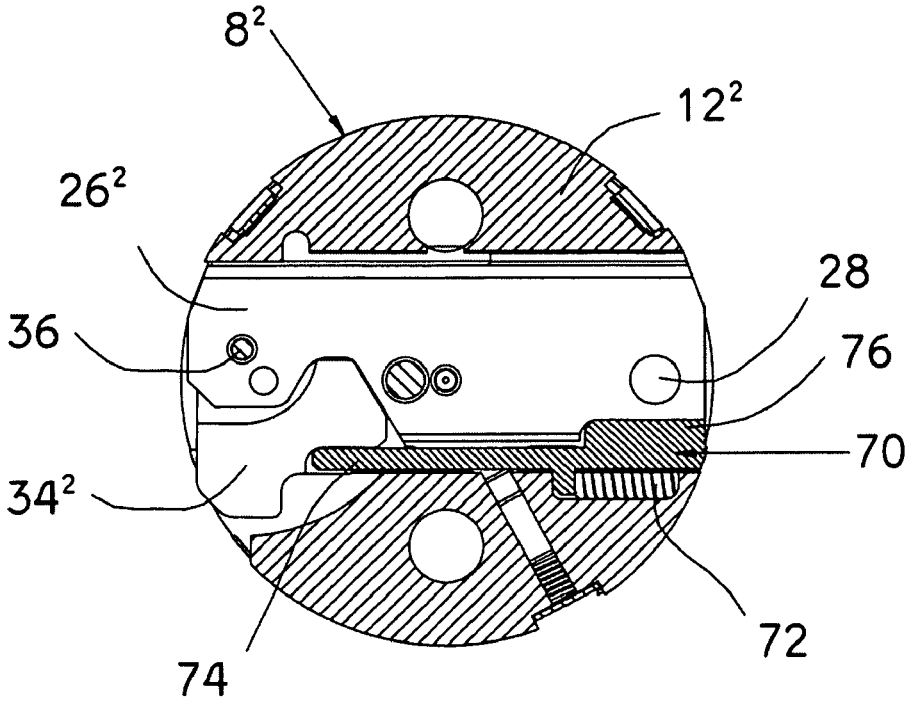
FIG. 8 is a sectional view of the improved fuze of the second embodiment, taken along line F—F in FIG. 2A.
Figure 9:
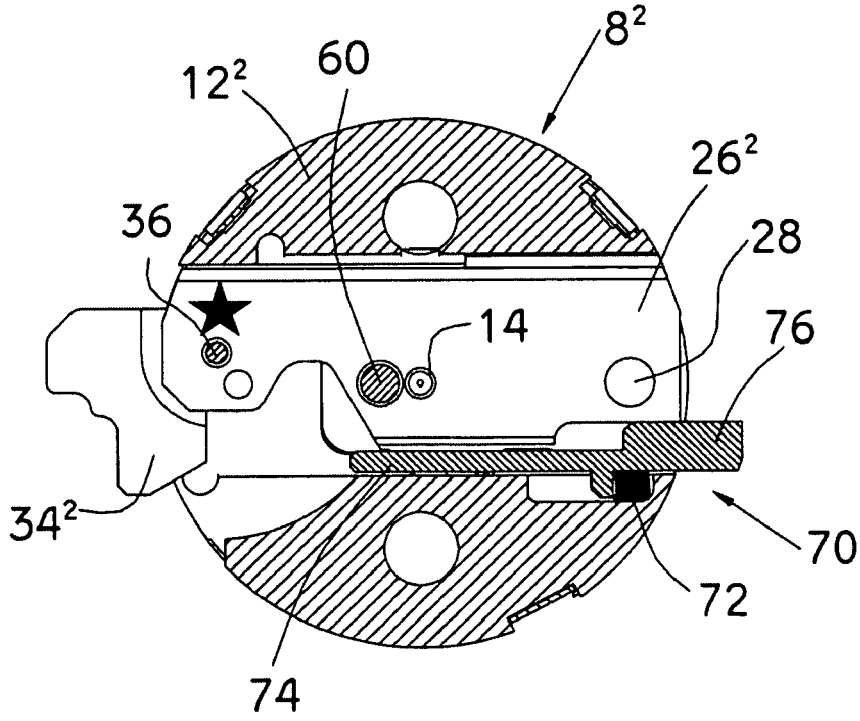
FIG. 9 is a sectional view of the improved fuze of the second embodiment, taken along line F—F in FIG. 3A.

Reference is now made to FIGS. 8 and 9 wherein there is shown a second embodiment of an improved fuze 8$^2$ having a somewhat different geometry, and having the mechanical inertial releasable safety apparatus for restraining the striker 34$^2$ configured somewhat differently. The improved fuze 8$^2$ includes a housing 12$^2$ a slider 26$^2$ a swivel mounted striker 34$^2$, and the other components of the first embodiment mutatis mutandis. However, in this second embodiment, the safety apparatus comprises a flat pin 70 that can reciprocate between a safe position shown in FIG. 8 and an activated position shown in FIG. 9. In the safe position, the tail 74 of the flat pin 70 engages the swivel mounted striker 34$^2$ preventing it from swinging around its pivot 36 and detonating the time delay detonator ignition system. In the activated position, as shown in FIG. 9, the flat pin 70 is displaced, so that it no longer engages the swivel mounted striker 34$^2$, allowing it to swivel around its pivot 36 and impact the time delay detonator ignition system 32.

The spin of the submunition grenade 8$^2$ around its axis applies a centrifugal force to the flat pin 70, displacing it from the safe position illustrated in FIG. 8, and urges it into the activated position as shown in FIG. 9. In the absence of an appropriate centrifugal force to the flat pin 70, a resilient means 72, typically a helical spring, keeps the flat pin 70 in its safe position.

When packed within the cargo projectile 4, the flat pin 70 of the improved fuze 8$^2$ appears as shown in FIG. 8, it being appreciated that the inner wall of the cargo projectile prevents the fist pin 70 moving outwards and assuming the activated position. Upon expulsion of the submunition grenade 2 from the cargo projectile 4 however, spin of the submunition grenade applies a centrifugal force that urges the pin 70 to slide out of the fuze housing 12$^2$ to assume its outer position as shown in FIG. 9, compressing the spring (resiliet means 72) in so doing. The movement of the flat pin 70 allows the swivel mounted striker 34$^2$ to rotate and impact the percussion cap 40, initiating the time delay detonator ignition system.

Figure 10:
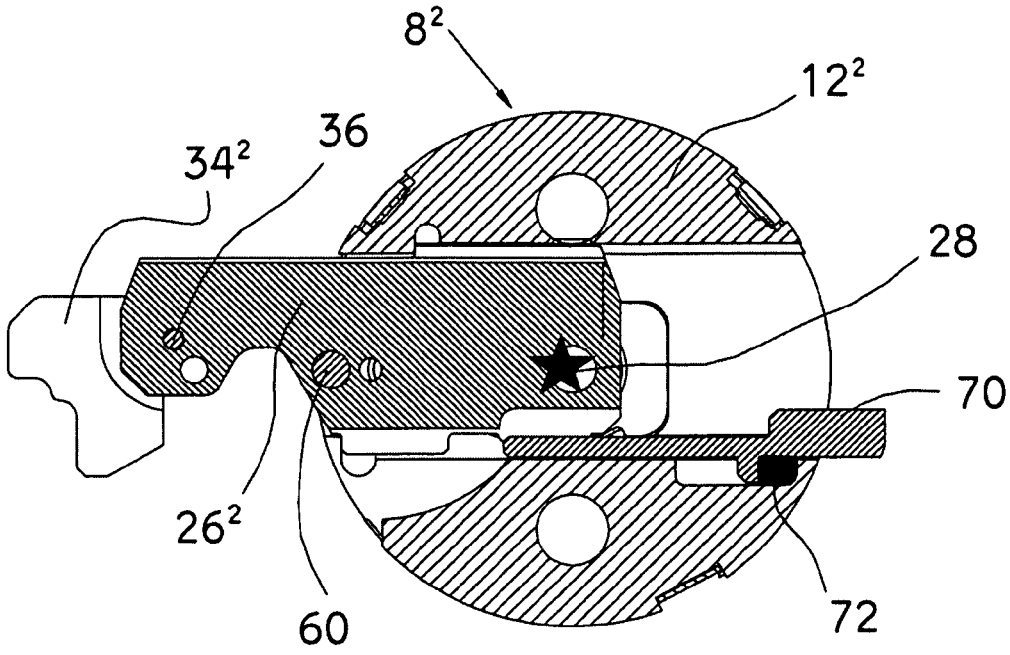
FIG. 10 is a sectional view of the improved fuze of the second embodiment, taken along line D—D in FIG. 5A.
Figure 11:
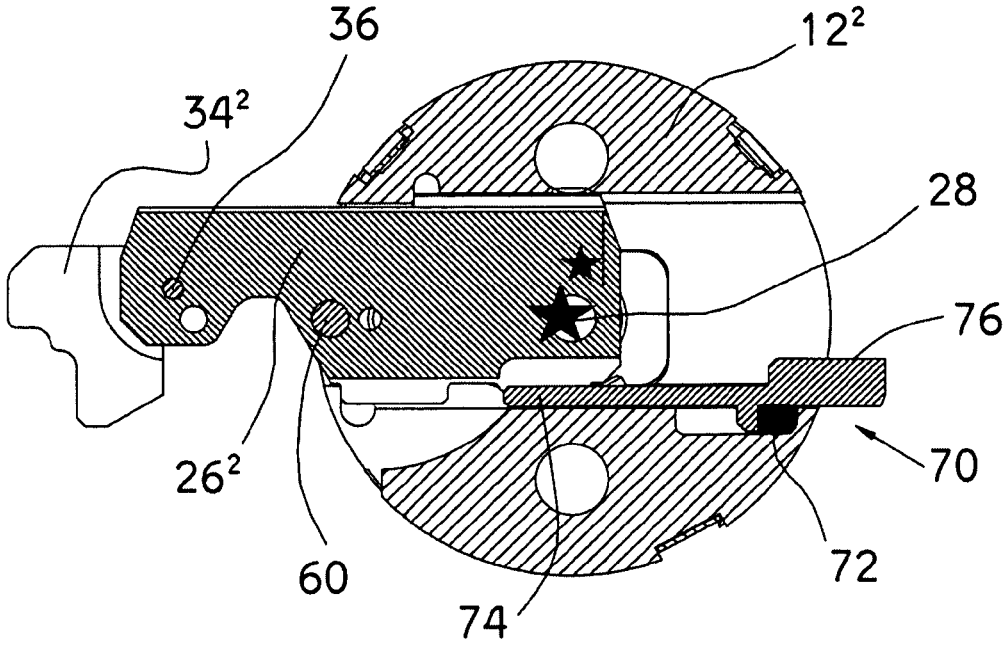
FIG. 11 is a sectional view of the improved fuze of the second embodiment taken along line D—D in FIG. 6A.

With reference to FIG. 10, under normal conditions, although the retraction of the flat pin 70 allows the initiation of the time delay detonator ignition system, the explosion of the submunition grenade 2 is caused by the firing pin 14 impacting the stab detonator 28. However, as shown in FIG. 11, where, should the submunition grenade 2 be properly armed due to centrifugal forces arising from the correct retraction of the firing pin 14 and the slider 26$^2$ sliding into the armed position, but the firing pin nevertheless fails to detonate the submunition grenade, since the retraction of the flat pin 70 releases the swinger 34$^2$, the time delay detonator ignition system 32 is triggered, and after the combustion front burns through the pyrotechnic charge, the booster charge 39 activates the stab detonator 28 and detonates the submunition grenade. Thus, by choosing an appropriate pyrotechnic combustion charge 38 of a few seconds, the time delay detonator ignition system 32 acts as an independent backup to primary firing pin, and the warhead 6 of the submunition grenade 2 will be detonated even in the event that the submunition grenade impacts at the wrong angle, or the firing pin sticks for example.

Figure 12:
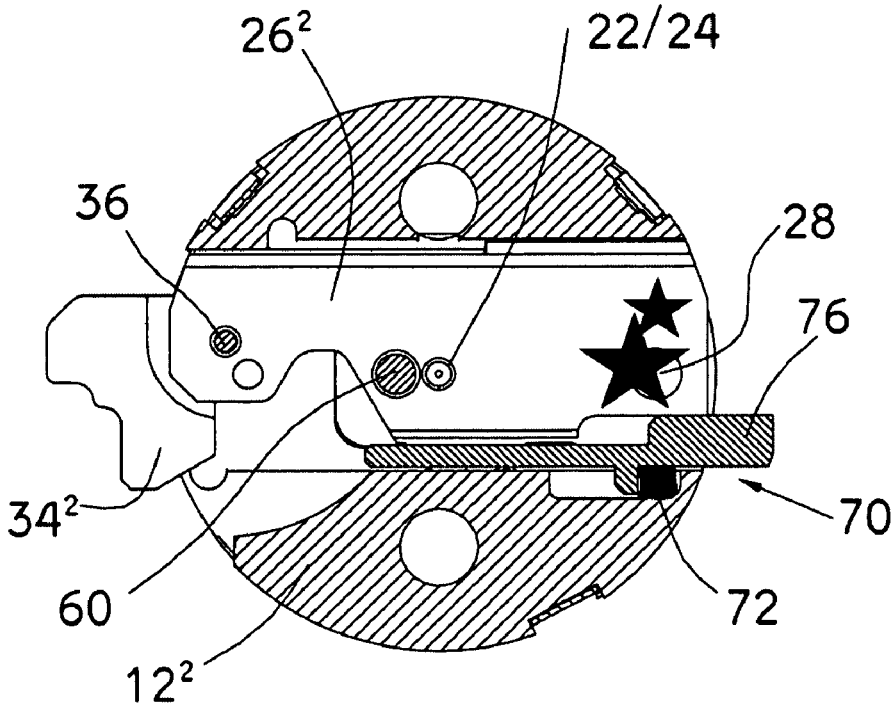
FIG. 12 is a sectional view of the improved fuze of the second embodiment, taken along line E—E in FIG. 7A.

Furthermore, referring to FIG. 12, in cases where the firing pin 14 fails to retract and the slider $\mathbf{26}^2$ fails to slide outwards preventing the stab detonator 28 from being brought into alignment with the firing pin, and the primary detonating mechanism cannot operate, the spin activated withdrawal of the flat pin 70 out of the fuze housing $\mathbf{12}^2$ allows the swivel mounted striker $\mathbf{36}^2$ to swing outwards, allowing it to strike the percussion cap 40 and activate the time delay detonator ignition mechanism. This eventuality results in the stab detonator 28 being ignited in the unarmed position after the pyrotechnic combustion charge 38 burns through, and in this manner, by destroying the highly reactive stab detonator 28, the submunition grenade 2 is rendered relatively harmless.

Figure 14:
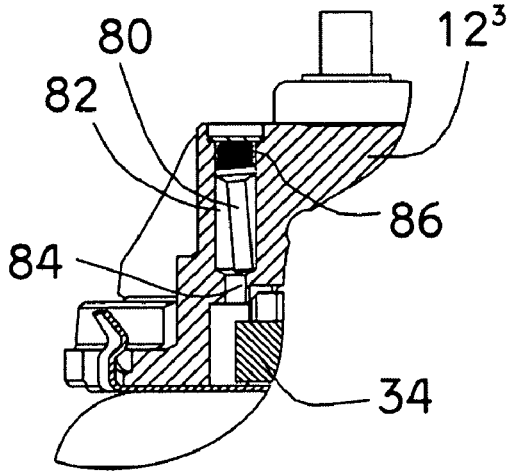
FIG. 14 is a cross-sectional view through the spring pin of the third embodiment.
Figure 13A:
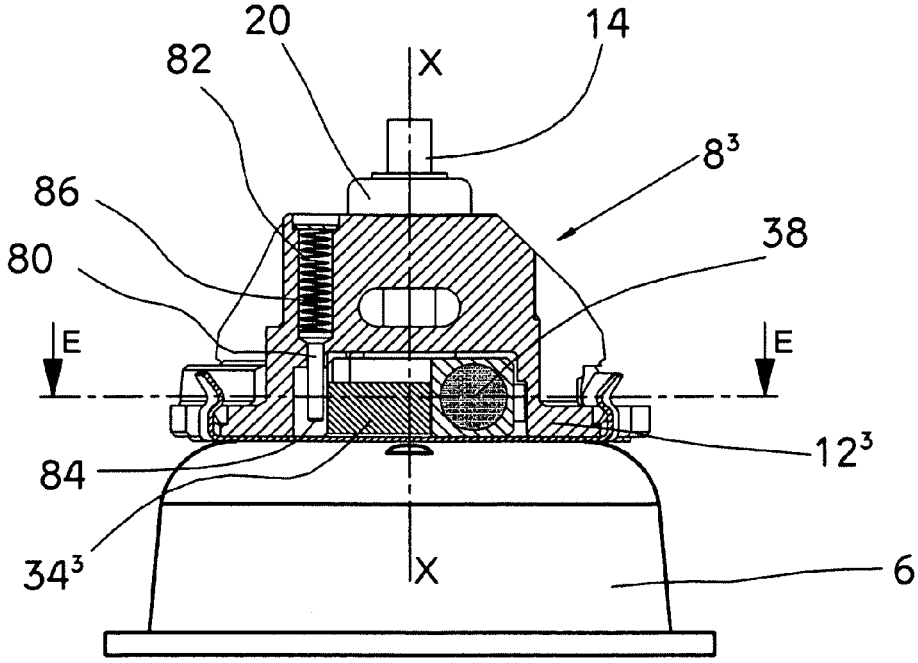
FIG. 13A is a side sectional view of a third embodiment of the improved fuze of the invention.
Figure 13B:
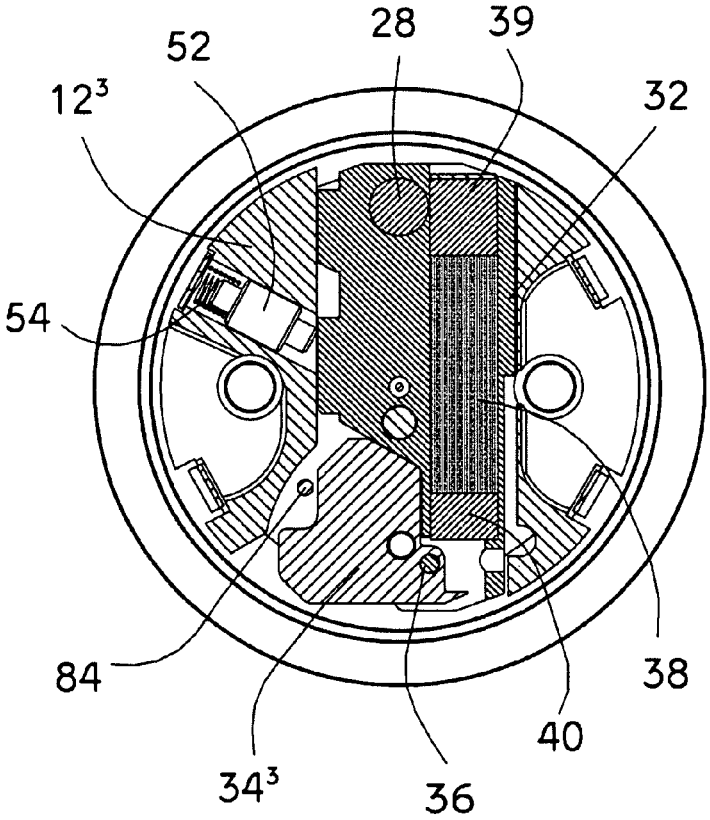
FIG. 13B is a sectional view of the embodiment of the improved fuze of FIG. 13A taken along line E—E therein.

With reference to FIGS. 13A and 13B there is shown a third embodiment of an improved fuze $\mathbf{8}^3$ in accordance with to present invention, having a somewhat different geometry, and having the striker mechanical inertial releasable safety apparatus configured somewhat differently. Here the safety apparatus comprises a spring pin 80 substantially parallel to the main axis X—X of the submunition grenade 2 and configured to be retractable into a cylindrical hole 82 within the fuze housing $\mathbf{12}^3$, The tip 84 of the spring pin 80 protrudes into the plane of the slider 26, and prevents the swivel mounted striker 34 from swiveling on its pivot 36 and impacting the percussion cap 40 of the time delay detonator ignition system 32. A resilient means such as a spring 86 obstructs the retraction of the spring pin 80 into the cylindrical hole 82. The inertial jolt occurring when the cargo projectile 4 is launched overcomes the resistance of the spring 86, causing it to compress, and drives the spring pin 80 of each submunition grenade 2 into the cylindrical hole 8. The spring pin 80 retracted into the hole 82 is shown in FIG. 14. Once retracted into the hole 82, the spring pin 80 is displaced sideways by the centrifugal forces acting thereon due to the spinning of the cargo projectile 4. Retraction of the spring pin 80 into the hole 82 allows the swivel mounted striker 34 to impact the percussion cap 40 of the time delay detonator ignition system 32. Once the spring pin 80 is retracted, the tip of the spring pin 80 is retracted out of the plane of the slider 26, and no longer prevents the swivel mounted striker 34 from swiveling on its pivot 36. In this manner the striker tooth is no longer prevented from striking the percussion cap and, due to the spinning of the submunition grenade, does so, thereby activating the time delay detonator ignition system 32, and the impact mode, self destruct mode and neutralization mode described above with reference to the first and second embodiments can occur.

In this third embodiment, as in the first two, where the firing pin retracts and the slider slides out under the effect of the centrifugal force, the submunition grenade should explode on impact due to the initiation of the stab detonator by the firing pin aligned therewith. If this does not detonate on impact, the time delay detonator ignition mechanism 36 will result in activation of the detonator after the pyrotechnic combustion charge burns through. Furthermore, as with the other embodiments, mutatis mutandis, should the firing pin fail to retract and/or the slider fail to slide, the time delay detonator ignition mechanism 36 will cause the destruction of the stab detonator of the unarmed submunition grenade after the pyrotechnic combustion charge bums through, and thereby render it comparatively safe.

Referring back to FIG. 1; when the submunition grenade 2 is discharged from the cargo projectile 4 the stabilizer 10 typically releases the folded length of nylon ribbon, 87 so that it unfurls (FIG. 2A). This slows down and alters the trajectory of the submunition grenade and results in other inertial forces acting thereon in addition to the centrifugal forces discussed hereinabove. In further embodiments (not illustrated), these other inertial forces can also be used instead of the centrifugal forces described above to release mechanical safety devices analogous to those described above.

It will be appreciated that in the present invention, the process of arming the fuze relies solely on physical forces which develop as a result of the firing conditions. There is no need to supply electrical energy or potential energy as stored in a spring or the like to arm the fuze. Even though the second and third embodiments include springs, it is not the release of pent up energy in the spring that triggers the device. The striker is released only by physical forces which develop as a result of the firing conditions. Nevertheless, this method of arming renders both the fuze and the submunition grenade safe prior to arming. This particularly facilitates their safe assembly. Furthermore, in contradistinction to other submunition grenade fuzes known to the applicants, activation of the delay detonator ignition system 32 of the improved fuze 8 of the present invention is dependent solely on the expulsion of the submunition grenade 6 from the carrier projectile 4.

It will be appreciated by persons skilled in the art that the present invention is not limited by what has been particularly shown and described hereinabove. Rather the scope of the present invention is defined only by the claims which follows, in which the word "comprise" and variations thereof, such as "comprising", "comprises" and the like, indicate that the device or process claimed includes the components or steps explicitly included, but does not imply the exclusion of other components or steps.

The invention claimed is:

1. An improved fuze for a submunition grenade designed to be launched from a cargo projectile; said cargo projectile comprising a fuze, a warhead and a casing; the improved fuze comprising a fuze housing; a threaded firing pin oriented coaxially with the submunition grenade, and threadedly engageable to a threaded bole in a weighted insert that is able to reciprocate within the fuze housing;

said firing pin having a pointed tip;

said firing pin being able to rotatably reciprocate between a forward position and a retracted position by rotation of said firing pin with respect to said weighted insert along said threadedly engaged screw threads;

a slider slidingly moveable in a substantially radial plane tangential to the axis of the firing pin, between a safe position and an armed position;

said slider having a cavity therein for engaging the pointed tip of the firing pin when said slider is in said safe position and said fixing pin is in said forward position; said slider having a stab detonator attached to an inner end of said slider, such that when said slider is in said safe position and said pointed tip engages said cavity, said stab detonator is securely held within said housing, and when said firing pin is in said retracted position and said slider is slid into said armed position, the stab detonator is brought into alignment with said firing pin, for detonation thereby after an impact or jolt;

said slider further comprising a time delay detonator ignition system for delayed ignition of the stab detonator and a spin activated swivel mounted striker for activating the time delay detonator ignition system, such that spin of the submunition grenade applies a rotational force on the firing pin and causes retraction of the firing pin along threadedly engaged screw threads into said weighted insert, retracting said tip out of said cavity, cocking the firing pin; and spin of the submunition grenade further applies a rotational force on said slider urging it from said safe position into said armed position, bringing said stab detonator into alignment with said firing pin without requiring stored energy in any form;

said fine further comprising a self-neutralizing mode including a fully mechanical inertial releasable safety apparatus for preventing swiveling of said swivel mounted striker, to prevent initiation of said time delay detonator ignition system wherein release of said swivel mounted striker whilst said slider is in said safe position triggers said time delay detonator ignition system, resulting in ignition of said stab detonator after said time delay whilst said stab detonator is held securely in said housing, disarming said submunition grenade thereby, rendering it relatively harmless.

2. An improved fuze for a submunition grenade as claimed in claim 1, wherein the time delay detonator ignition system comprises a pyrotechnic combustion charge and a percussion cap, such that said percussion cap is triggerable by an impact resulting from swiveling of said swivel mounted striker, and said percussion cap actuates said pyrotechnic combustion charge for ignition of said stab detonator.

3. An improved tine for a submunition grenade as claimed in claim 1, wherein:

(a) when said firing pin retracts and the slider is moved into the aimed position bringing the stab detonator into alignment with the firing pin and arming the submunition grenade thereby, in absence of the firing pin initiating the stab detonator, the time delay detonator ignition system initiates the stab detonator after elapsing of the time delay;

(b) spin of the submunition grenade causes an inertial force to be applied to the firing pin, resulting in refraction of the firing pin out of the cavity, cocking the firing pin; the spin of the submunition grenade further applies an inertial force onto the slider urging it from safe position into said armed position, bringing said stab detonator into alignment with said firing pin.

4. An improved fuze for a submunition grenade as claimed in claim 3, wherein the inertial force includes a centrifugal force.

5. An improved fuze for a submunition grenade as claimed in claim 3, wherein the inertial force includes a sudden jolt resulting from launching of said cargo projectile.

6. An improved fuze for a submunition grenade as claimed in claim 3, wherein the inertial force includes a sudden jolt resulting from said submunition grenade being expelled from said cargo projectile.

7. An improved fuze for a submunition grenade as claimed in any of claims 2 to 6, wherein the fully mechanical inertially releasable safety apparatus comprises a small block that is wedgeable into the fuze housing and, when wedged therein, the small block prevents the swiveling of the swivel mounted striker, such that upon the submunition grenade being ejected from the cargo projectile, spin of the submunition grenade results in a centrifugal force that causes detachment of said block from the fuze housing; said detachment of the block allows the swivel mounted striker to swivel into a position such that it strikes said percussion cap and activates the time delay detonator Ignition system.

8. An improved fuze for a submunition grenade as claimed in any of claims 1 to 6, wherein the fully mechanical inertially releasable safety apparatus comprises a flat pin and a resilient retaining means; said flat pin being able to reciprocate between an inner position and an outer position, said resilient retaining means for urging said flat pin towards said inner position, such tat upon expulsion of said submunition grenade from said cargo projectile, inertial forces causes the flat pinto slide out of the fuze housing, allowing the slider assembly to slide out of the fuze housing assuming said outer position and releasing said swivel mounted striker.

9. An improved fuze for a submunition grenade as claimed in claim 8, wherein said inertial forces include centrifugal forces resulting from spinning of the submunition grenade.

10. An improved fine for a submunition grenade as claimed in claim 8, wherein said inertial forces include a sudden jolt resulting from an unraveling of a drag means attached to said flat pin on expulsion of the submunition grenade from the cargo projectile.

11. An improved fine for a submunition grenade as claimed in any of claim 1 to 6, wherein said fully mechanical inertially releasable safety apparatus comprises a spring-pin resiliently mounted within a cylinder and retractable there into, said spring pin and said cylinder being aligned wit longitudinal axis of said submunition grenade.

12. A submunition grenade including an improved fuze as described in claim 1.

* * * * *

UNITED STATES PATENT AND TRADEMARK OFFICE

CERTIFICATE OF CORRECTION

PATENT NO. : 7,168,367 B2
APPLICATION NO. : 10/817535
DATED : January 30, 2007
INVENTOR(S) : Amir Levy et al.

It is certified that error appears in the above-identified patent and that said Letters Patent is hereby corrected as shown below:

Column 14,

Claim 8; line 26, "tat" should be --that--

Signed and Sealed this

First Day of May, 2007

JON W. DUDAS
*Director of the United States Patent and Trademark Office*